US005713417A

United States Patent [19]

Sundholm

[11] Patent Number: 5,713,417

[45] Date of Patent: Feb. 3, 1998

[54] METHOD AND EQUIPMENT FOR FIRE FIGHTING

[76] Inventor: Göran Sundholm, Ilmari Kiannon kuja 3, SF-04310, Tuusula, Finland

[21] Appl. No.: 946,301

[22] PCT Filed: Jun. 18, 1992

[86] PCT No.: PCT/FI92/00193

§ 371 Date: Nov. 2, 1992

§ 102(e) Date: Nov. 2, 1992

[87] PCT Pub. No.: WO92/22353

PCT Pub. Date: Dec. 23, 1992

[30] Foreign Application Priority Data

| | | | |
|---|---|---|---|
| Jun. 19, 1991 | [FI] | Finland | 913018 |
| May 5, 1992 | [FI] | Finland | 922020 |
| May 22, 1992 | [FI] | Finland | 922355 |

[51] Int. Cl.[6] ..... A62C 35/00

[52] U.S. Cl. ..... 169/46; 169/9; 169/62

[58] Field of Search ..... 169/46, 62, 9, 169/37, 70, 13

[56] References Cited

U.S. PATENT DOCUMENTS

| | | | |
|---|---|---|---|
| 2,537,009 | 1/1951 | Allen et al. | 169/9 |
| 3,684,019 | 8/1972 | Emmons et al. | 169/1 A |
| 3,889,756 | 6/1975 | Dunn | 169/62 |

FOREIGN PATENT DOCUMENTS

| | | | |
|---|---|---|---|
| 129629 | 1/1985 | European Pat. Off. . | |
| 0694490 | 12/1930 | France | 169/9 |
| 3825078 | 4/1991 | Germany . | |
| 1674865 | 9/1991 | Russian Federation | 169/9 |
| 0893446 | 4/1962 | United Kingdom | 169/9 |
| 9107208 | 5/1991 | WIPO . | |
| 4008659 | 4/1994 | WIPO | 169/9 |

*Primary Examiner*—David M. Mitchell
*Attorney, Agent, or Firm*—Ladas & Parry

[57] ABSTRACT

The object of the invention is to provide a new method and a new equipment for extinguishing fires especially in engine rooms and similar spaces. The fire is extinguished or at least pressed down by means of concentrated fog sprays with strong penetrating power, by utilizing high operating pressure, which is gradually decreased for the provision of spread fog-like liquid spraying. The extinguishing liquid is preferably delivered to spray heads (43, 44, 45) by using hydraulic accumulators (41, 41*a*).

24 Claims, 7 Drawing Sheets

METHOD AND EQUIPMENT FOR FIRE FIGHTING

The present invention relates to a method and apparatus for fire fighting, especially in engine rooms of ships and the like.

In spite of big amounts of water, prior art sprinkler installations have proved to be ineffective for extinguishing fires in engine rooms.

Prior art foam-extinguisher installations have also proved to be ineffective, because the foam cannot press down on the fire sufficiently. Instead, the foam is destroyed by flue gases generated at the beginning of the fire.

The object of the invention is to provide a new method and apparatus for effectively extinguishing fires that are difficult to extinguish as in engine rooms of ships and the like.

The invention is mainly characterized in that extinguishing liquid is sprayed via spray heads producing concentrated fog sprays with a strong penetrating power from a high initial operating pressure in order at least to press down a fire. Thereafter, the operating pressure is reduced so that a spread out fog-like liquid spray is provided for effective heat absorption.

Fire fighting apparatus described, e.g., in the Finnish Patent Applications 911028, 912434, 913059, 914704, 914823 and 915078 can operate at a high pressure to produce fog sprays of extinguishing liquid, e.g., water that effectively press down a fire in an engine room of a ship, for instance, with a small amount of water, e.g. 10 liters water for a fire of 10 MW. Such a small amount of water is not, however, capable of cooling down a Diesel engine, boiler or another so-called risky part in which a fire usually breaks out sufficiently that no risk of reignition remains. Moreover, the high pressure water is needed during a short time of, e.g., 10 seconds. An electric drive for this would lead to a disproportionate increase in load.

According to a preferred embodiment of the invention, accumulated energy is utilized in the form of pressure bottles, so-called hydraulic accumulators, in which nitrogen or air is suitably used as compression gas. As water put into such accumulators, the gas is compressed, whereby water and pressure energy are accumulated. The charging pressure of the hydraulic accumulators is preferably about 250 to 300 bar and the amount of accumulated water, about 200 l.

After the fire has been either extinguished or at least pressed down by concentrated fog sprays penetrating the accumulation of hot air and hot flue gases above the fire, general cooling becomes needed. For this, the concentrated fog sprays waste of restricted amount of water available. A more evenly spread out fog-like liquid spray would improve the capability of absorbing heat.

For this, preferably, the flow resistance of the individual nozzles of the spray heads is adjusted in such a way that a spread out fog-like spray formation occurs when the pressure of the hydraulic accumulators has fallen to, e.g., about 110 bar during discharge, whereby the initial counterpressure of the accumulators can be about 70 bar. In addition to saving water, the spread out fog-like spray formation is also gentle to electric installations that may be at the site.

After the hydraulic accumulators have been emptied, which usually takes about 1 minute, the accumulators are recharged. During charging, liquid can be sprayed through the spray heads with the feed line pressure of, e.g., 5 to 10 bar. If only cooling remains necessary for the prevention of reignition, the recharge of the accumulators can be interrupted at a pressure of, e.g., about 110 bar. Then the accumulators can be emptied again for producing another cooling spread out fog-like spray formation. Foam can also be applied in combination with such fog-like liquid spraying for the prevention of reignition, as will be described in greater detail later on.

In a preferred embodiment of the invention, each spray head comprises a housing, an inlet into the housing for liquid, a central channel in the housing from the inlet to a centrally positioned nozzle, and branchings extending from the central channel, the branchings leading to nozzles directed preferably obliquely to the sides. The nozzles are preferably arranged to operate with a high pressure for generating fog sprays.

A valve body in connection with the inlet is loaded by a spring so that at a rest pressure in the liquid supply line to the inlet, the valve body closes the connection of the inlet to the central channel of the spray head. The valve body is driven by a regular working pressure for extinguishing into the central channel against the spring and, more particularly, the valve body is dimensioned such that, in a flow slit, i.e. passage, between the valve body and the wall of the central channel, a pressure fall big enough to drive the valve body to the opposite end of the central channel occurs, whereby to close the connection from the central channel to the centrally positioned nozzle.

Different preferred embodiments of the invention have been defined in greater detail in the claims presented later on.

In the following, the invention will be described more accurately with reference to exemplifying embodiments shown in the enclosed drawing.

Figure 1:
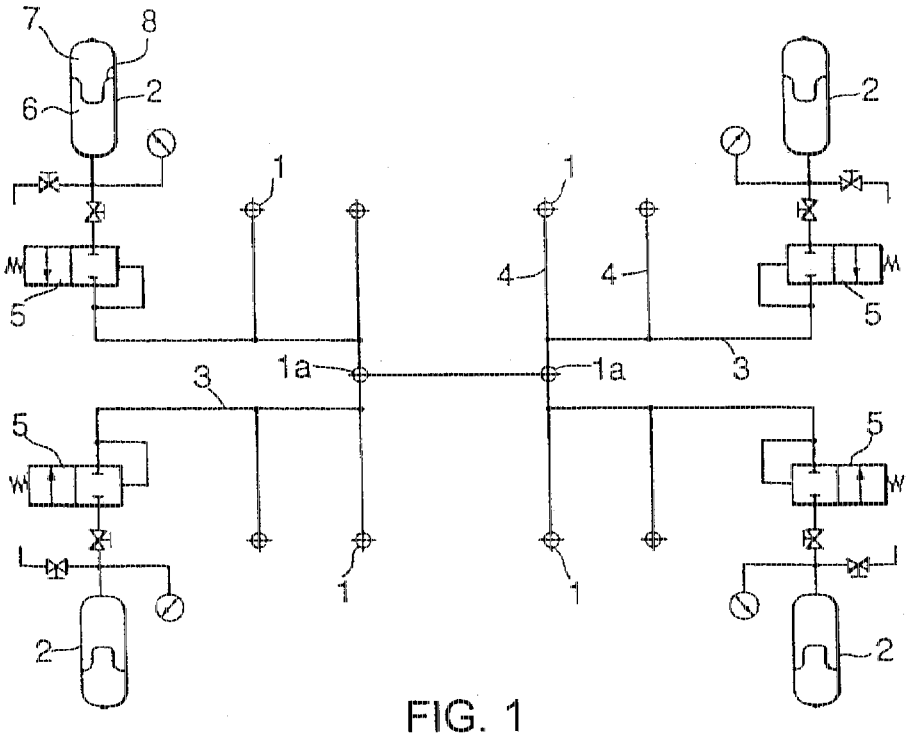
FIG. 1 is a schematic diagram of an embodiment which is suitable for fire fighting in relatively small spaces.

In FIG. 1, spray heads 1 are located in ship cabins, for example, while spray heads 1*a* are in a cabin corridor.

Four high pressure hydraulic accumulators 2 are connected in parallel. Lines 3 and 4 extending from the accumulators and branch to the spray heads. The lines 3 and 4 are preferably flexible fireproof hoses.

At the outlet of each accumulator 2 is preferably positioned a valve 5 which, in a rest condition with none of the spray heads activated, maintains a relatively low pressure of, e.g., 10 bar in the lines 3 and 4. If this pressure falls, e.g., if one of the spray heads begins to operate, the valves 5 open to supply a full working pressure of the accumulators 2 of about 100 to 200 bar to the spray heads.

The hydraulic accumulators 2 can comprise a liquid space 6 and a gas space 7 separated by a membrane 8. If the volume of the accumulator is 20 l, the initial pressure is 45 bar and the charging pressure about 200 bar, the accumulator is capable of delivering a liquid flow of about 14 l in about 1.3 minutes.

Instead of a gas space and membrane, the accumulators can also utilize as driving power a mixture of water and nitrogen or they can be of the piston type (not shown), possibly provided with a drive spring (not shown).

Figure 2:
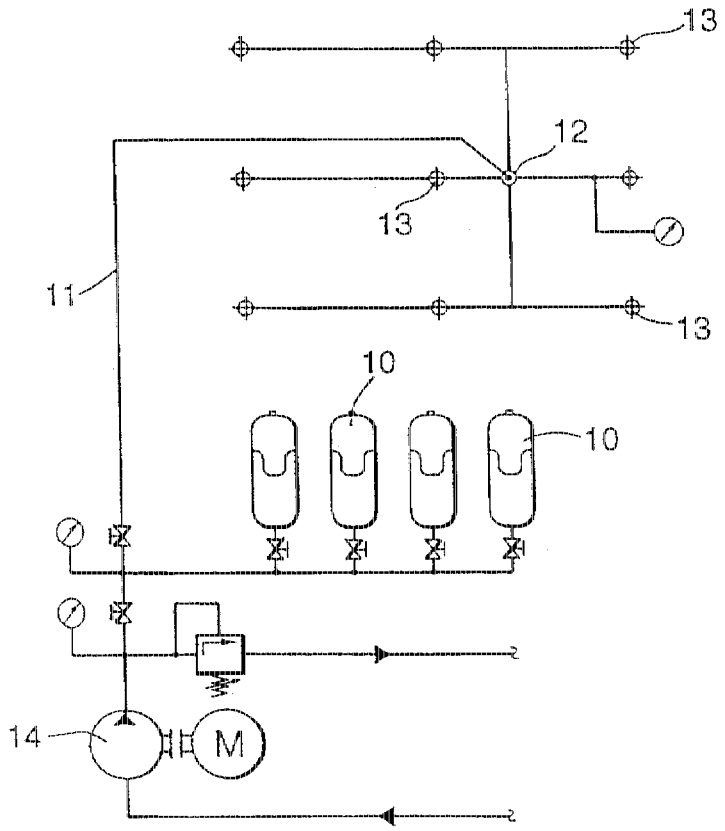
FIG. 2 is a schematic diagram of an alternative to the embodiment of FIG. 1.

In FIG. 2, four hydraulic accumulators 10 are connected in parallel with a common outlet line 11 leading to an automatic release valve 12 from which branchings extend to a number of spray heads 13. A motor-driven pump 14 is utilized for charging the hydraulic accumulators 10.

Figure 3:
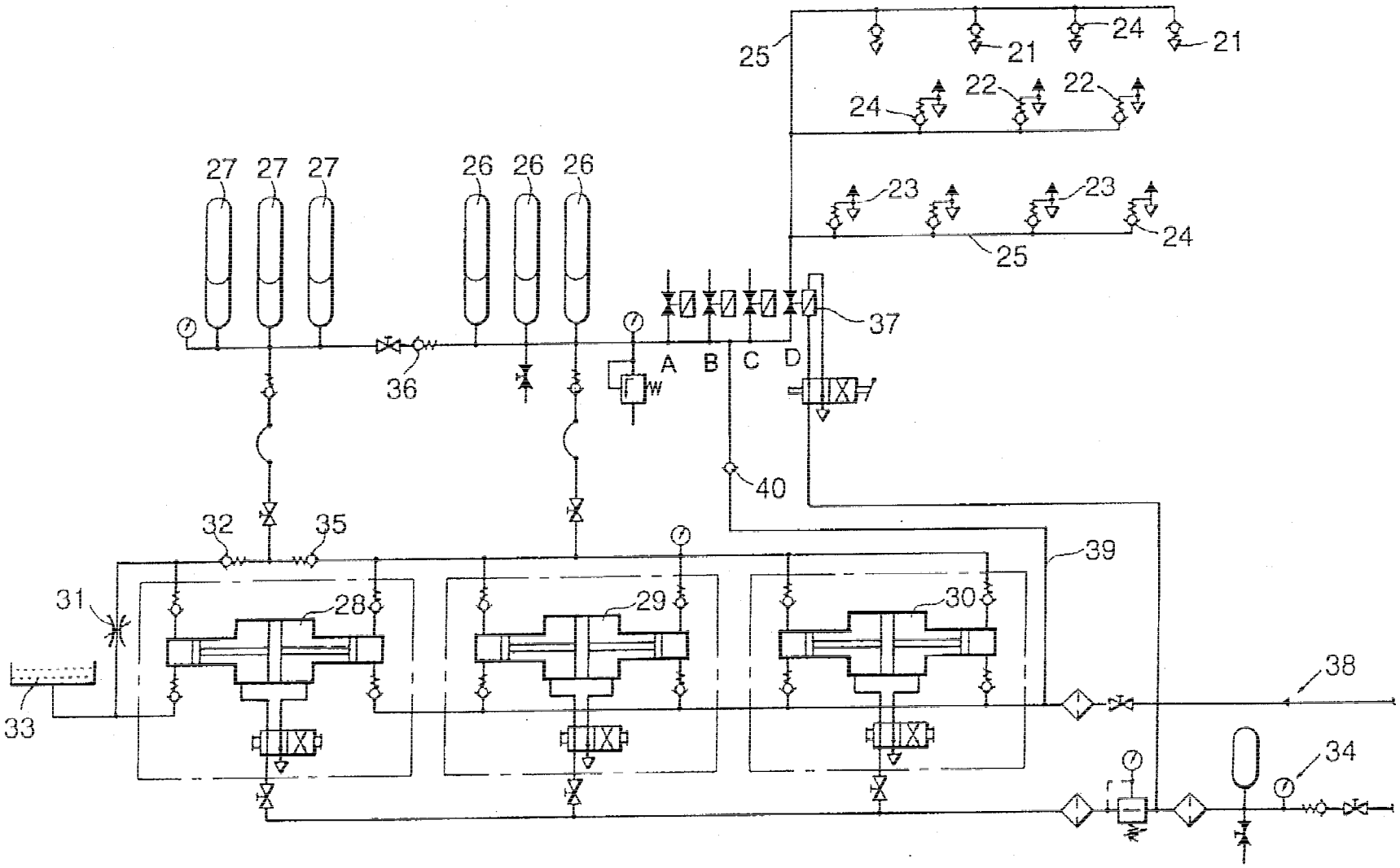
FIG. 3 is a schematic a diagram of another embodiment intended to be used for fire fighting in engine rooms of ships or similar spaces.

In FIG. 3, there are a number of spray heads 21, e.g., above a Diesel engine (not shown) in an engine room, spray heads 22 positioned by the engine, e.g., in the grates of the engine room floor, and spray heads 23 in a floor plate above the bilge. The spray heads 21, 22 and 23 are preferably of the type described, e.g., in the Finnish Patent Applications 911028, 912434, 913059, 914704, 914823 and 915078, which are capable of producing a water fog at a high working pressure. The spray heads 21 above the engine are directed downwards, while the spray heads 22 and 23 are preferably provided with nozzles directed both upwards and downwards.

The spray heads 21, 22 and 23 are connected by nonreturn valves 24 to a pipe system 25 to keep the pipe system 25 filled with water before fire extinguishing with the equipment starts.

Three first hydraulic accumulators 26 for water and three second hydraulic accumulators 27 for film forming foam with a foam content of, e.g., 3 to 12% are connected to the pipe system 25. The charging pressure of the accumulators 26 is, e.g., 250 to 300 bar and, when the working pressure of the fire fighting equipment is supposed to be about 100 bar, the water accumulators 26 can have an effective working overpressure of about 140 bar and the foam accumulators 27 an effective working overpressure of about 70 bar.

Compressed-air driven liquid pumps indicated by 28, 29 and 30 are preferably used for charging the accumulators 26 and 27. These pumps are arranged to stop automatically when a set pressure has been achieved. To portion out foam concentrate in the right proportion, the pump 28 is provided with a bypass flow valve 31 as well as with a nonreturn valve 32 for portioning out a desired percentage of foam concentrate from a tank 33.

The system is charged as follows.

The pneumatic operating system, generally indicated by 34, of the pumps 28, 29 and 30 is switched on, due to which the pumps 28, 29 and 30 start pumping. The left end of the pump 28 in the drawing pumps foam concentrate, the right end of the pump 28 in the drawing and the pumps 29 and 30 pump water. Because the pressure is lower in the accumulators 27 than in the accumulators 26, all pumps pump at first to the accumulators 27. The valve 31 can, e.g., be adjusted in such a way that as long as the pressure is lower than 140 bar (overpressure), the foam concentrate from the tank 33 is about 6% of the volume pumped by the combination of pumps 28, 29 and 30.

When the pressure exceeds 140 bar, the water pumps 28, 29 and 30 charge all the accumulators 26 and 27. Valves 35 and 36 prevent the foam from going to the water accumulators 26. After the pressure has risen to a predetermined value, the pumps stop automatically.

The fire fighting procedure is described as follows.

When a fire breaks out within the sphere of influence of the spray heads 21, 22 and 23, a connecting valve 37 of the pipe system 25 opens to connect the accumulators 26, 27 to the pipe system 25. To prevent the charged energy from being wasted for filling the pipe system 25, the spray heads 21, 22 and 23 are provided with the nonreturn valves 24 that prevent the pipe system 25 from being emptied.

During the first extinguishing stage, the water accumulators 26 dominate and the addition of foam is very little. The percentage of the foam increases gradually as the pressure falls in the system until, toward the end, the percentage of foam reaches the predetermined value of, e.g., about 6%.

The method of extinction according to the invention, as described above, manages with a small amount of foam, which saves costs and is, moreover, environmentally friendly. For example, about 500 l of foam concentrate are consumed in a corresponding prior art system with low pressure foam spraying, while the system of the invention copes with only 5 to 10 l of foam. After the pressure has fallen enough as a result of the discharge of the accumulators 26 and 27, the valve 37 is closed and the pumps 28, 29 and 30 start automatically and begin to recharge the accumulators 26 and 27. At this point the fire is in most cases extinguished.

The equipment can, of course, serve several different Diesel engines, boilers, etc., which is indicated in the drawing by the three valves at A, B and C for other pipe systems (not shown) on the left side of the valve 37 at D for the pipe system 25.

To secure an even portioning out of foam concentrate, at least the pump 28 is preferably a twin pump for water and foam concentrate, due to which the pump for portioning stops also when the water pump stops; the pump for portioning out foam would otherwise be going all the time.

The reference numeral 38 indicates a water pipe extending to the pumps 28, 29 and 30.

A by-pass branching 39 provided with a nonreturn valve 40 extends from the pipe 38. The branching can be utilized for delivering to the spray heads 21, 22 and 23 liquid for continued cooling.

Figure 4:
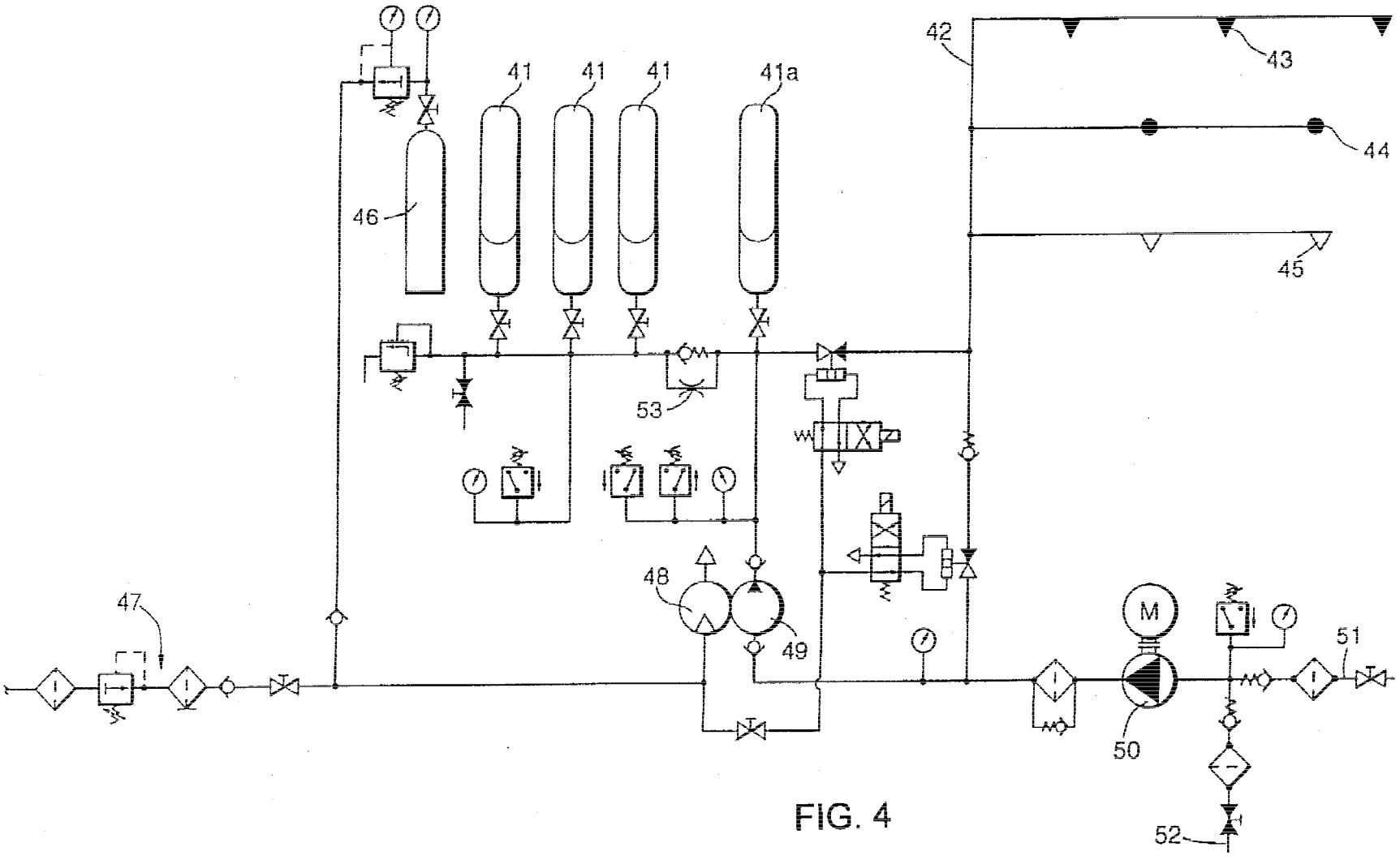
FIG. 4 is a schematic diagram of an alternative to the embodiment of FIG. 3.

In FIG. 4, four hydraulic accumulators 41 and **41*a* are connected in parallel by a common outlet line 42 to a number of spray heads 43, 44 and 45 like the spray heads 21, 22 and 23 of FIG. 3. The hydraulic accumulators 41, 41*a* can have an initial pressure of about 70 bar and a volume of about 50 liters each. A pressure bottle 46, which can have a pressure of 200 bar and a volume of 20 liters, can be used in case of a disturbance in a compressed-air supply line 47 for driving a pneumatic motor 48. The motor drives a pump 49 for charging the accumulators 41, 41*a***.

A motor-driven pump 50 with a working pressure of, e.g., 10 to 15 bar can be connected alternatively to a supply line 5 of fresh water at a pressure about 5 bar or to a line 52 of lake- or sea-water at a pressure 5 to 10 bar. The pump 50 also can be utilized for delivering water to the spray heads 43, 44 and 45 for cooling purposes while the accumulators 41 are being recharged after having been emptied.

At least somewhat before the discharge of the accumulators 41, **41*a*, the pump 50 is preferably arranged to spray low pressure water through the spray heads 43, 44 and 45 to cool these before switching on the high operating pressure of the accumulators. As a result, the spray heads and their nozzles can better resist the mechanical stresses caused by a sudden switching on of the fully charged accumulators. The pump 50** can, also preferably, deliver liquid to more of the spray heads over a larger area immediately after a fire has been detected until the fire has been located more precisely.

A throttling valve 53 in parallel combination with a nonreturn valve is connected between the hydraulic accumulator 41*a* and the other accumulators 41 in such a manner that the accumulator 41*a* is charged more quickly than the others and can be emptied again, if necessary, after a considerably shorter time than is possible if all of the accumulators had to be recharged in parallel.

Figure 5:
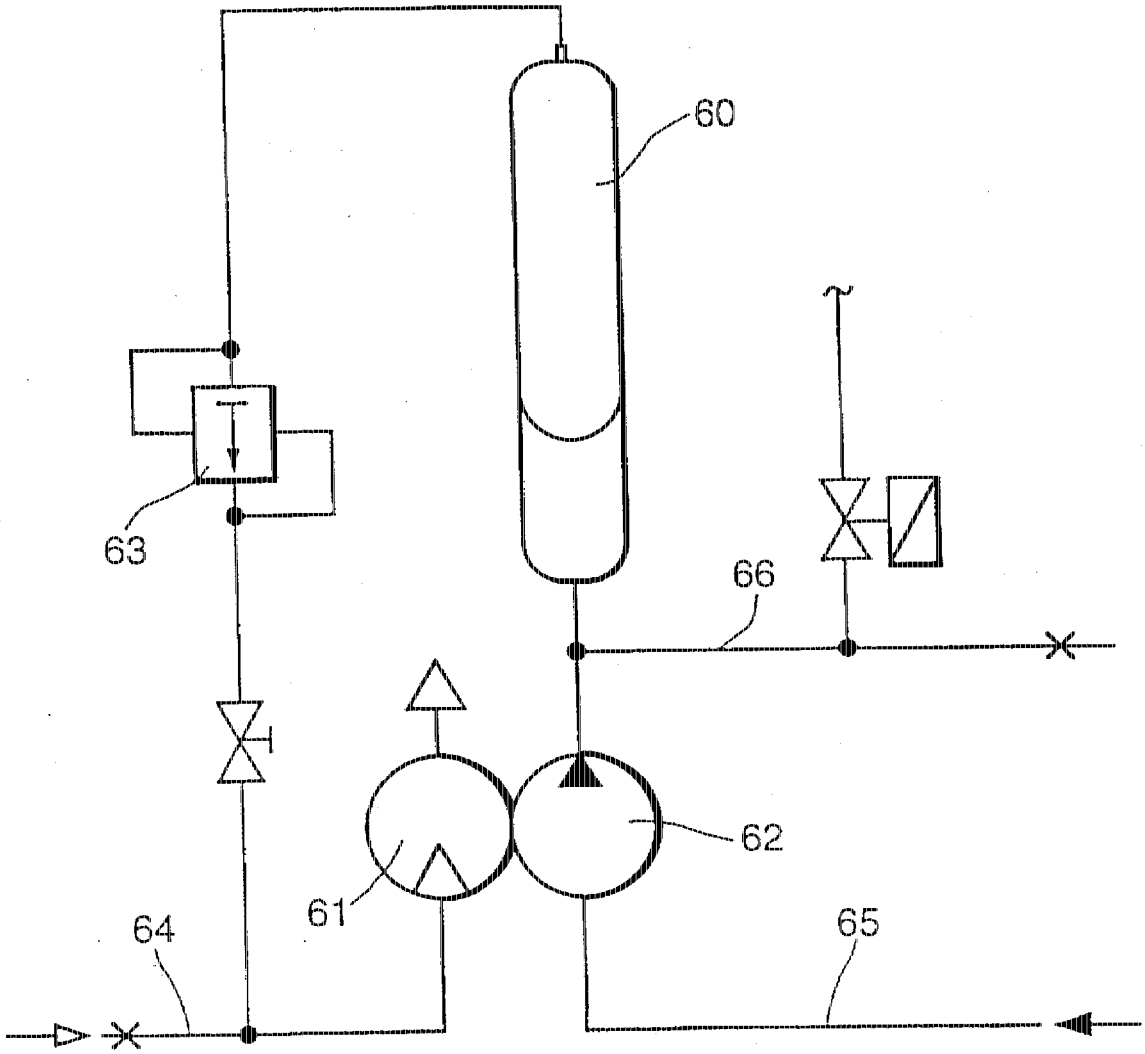
FIG. 5 is a schematic diagram of an alternative structure for a portion of the embodiment according to FIG. 4.
Figure 6:
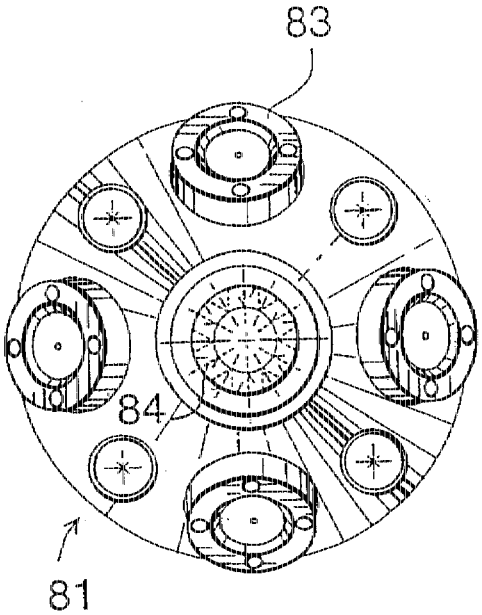
FIG. 6 is a bottom view of a spray head from the outlet side of the nozzles.

In FIG. 5, a pneumatic motor drives a pump 62 with a working pressure of, e.g., 280 bar for charging a hydraulic accumulator 60. The liquid supply of the pump 62 is indicated by 65 and the outlet line of the accumulator 60 by 66.

The initial pressure of the accumulator 60 is preferably relatively high, e.g., about 150 bar. If the regular air pressure supply line 64 is interrupted, it is possible to utilize the gas in the accumulator 60 for recharging the accumulator 60 via a proportional pressure reducing valve 63 after emptying. This possibility of recharging the accumulator 60 is, of course, restricted by the fact that the initial pressure in the accumulator 60 will fall with a decreasing amount of gas, but is at least possible to achieve a degree of charging sufficient for one or more repeated discharges of the spread out fog-like liquid sprayings that absorb heat.

In FIGS. 6 to 9, a spray head 82 has a body or housing. Four nozzles 83 are directed obliquely downwards around a centrally positioned nozzle 84. The nozzles 83 are intended to work at a high pressure of, e.g., 100 bar or more to cause fog-like liquid sprayings, that preferably, mutually cooperate to form a common directional fog spray with a high penetrating power. The construction and mutual arrangement of the nozzles 83 correspond, preferably, to what has been said in the Finnish Patent Applications 912434, 913059, 914704 and 915078.

The liquid inlet 85 of the spray head 81 extends into a central channel 86 that leads directly to the central nozzle 84 and branches into channels 87 to the nozzles 83.

Figure 7:
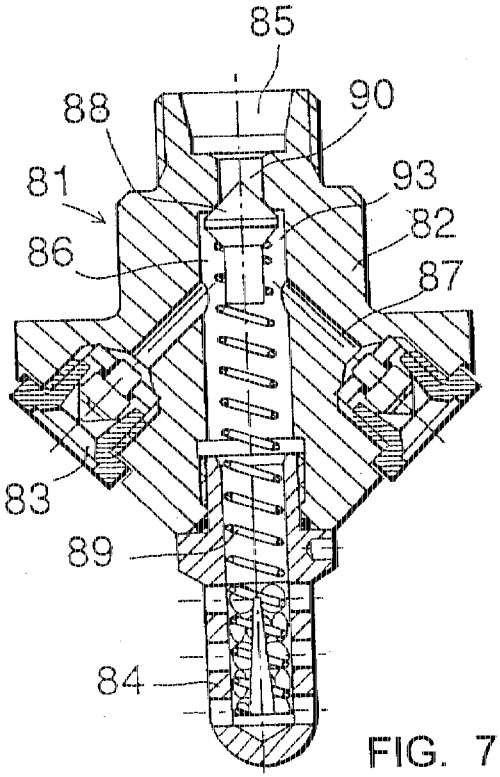
FIG. 7 is a longitudinal elevation in cross section of a spray head in an inactive state.

In the channel 86 is a valve body 88 that bears against the end of the channel 86 at the inlet 85 under the influence of a spring 89 to close the connection 90 between the liquid inlet 85 and the channel 86 when the spray head is in an inactive state as shown in FIG. 7. For this purpose, the valve body 88 comprises, e.g., a cone 91 to bear against a likewise conical sealing surface 92 of the housing 82.

After a fire has broken out and the fire fighting equipment is activated, there is a high pressure of, e.g., 100 bar at the inlet 85. The high pressure presses the valve body 88 away from the surface 92 against the spring and liquid flows past the cone 91 through a gap or split 93 between the base of the cone 91 and the wall of the channel 86. The split 93 is so narrow that the pressure fall across the split remains great enough for the pressure to force the valve body against the spring 89 until the valve body 88 strikes the bottom of the channel 86 and closes the connection from the channel to the central nozzle 84, preferably by means of conical contact sealing like that of the cone 91 and surface 92. This is shown in FIG. 8.

Figure 9:
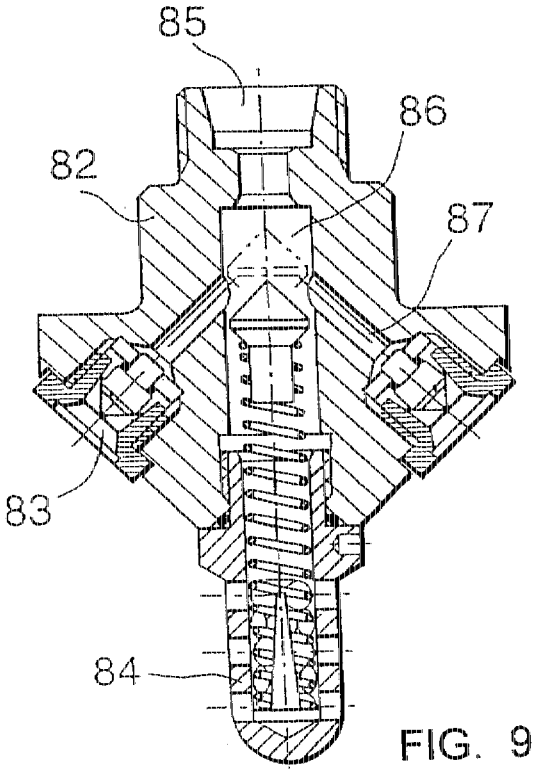
FIG. 9 is a longitudinal elevation in cross section of the spray head of FIG. 7 in a second stage of the activated state.

If the extinguishing liquid is delivered by the hydraulic accumulators, the pressure in these falls gradually until the spring 89 is capable of pressing the valve body 88 away from the position shown in FIG. 9 to a position as shown in FIG. 9 with the cone 91 approximately in the middle portion of the channel 86. As a result, the liquid flows past the valve body 88 to the central nozzle 84 which has a lower flow resistance than the nozzles 83. In the vast majority of cases, the fire is already extinguished at this stage by means of the fog sprays through the nozzles 83 during the first step of extinction when the spray head is in the condition shown in FIG. 7. The continued liquid spraying through the central nozzle 84 then serves for cooling in order to prevent a reignition. A continued spraying of liquid through the central nozzle 84 in the position of FIG. 9 is possible, if necessary, by utilizing a conventional water pipe with a pressure of about 7 bar even after the hydraulic accumulators have been emptied entirely and are, possibly, being recharged.

The nonreturn valves 24 that are shown separately in FIG. 3 are included in the spray heads in accordance with the FIGS. 6 to 9. The same function can be provided, however, in other ways that are not shown.

Figure 8:
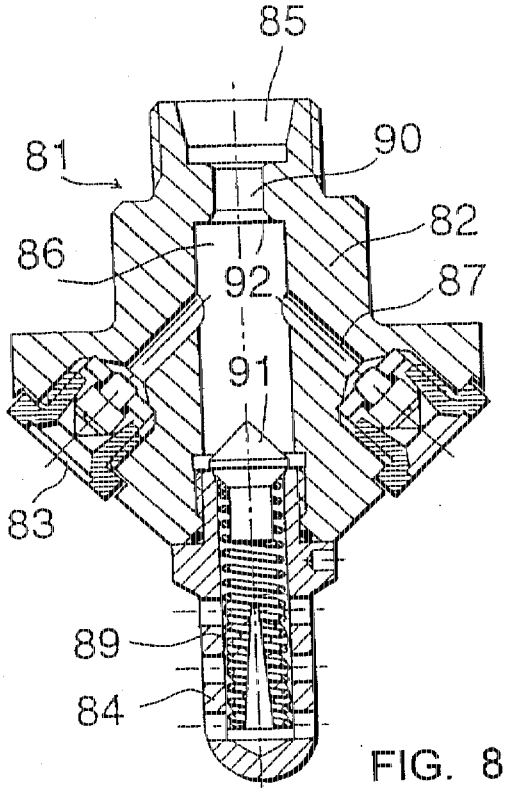
FIG. 8 is a longitudinal elevation in cross section of the spray head of FIG. 7, at a first stage of an activated state.

Before the spring 89, presses the valve body 88 from the position of FIG. 8 to the position of FIG. 9, concentrated fog sprays with strong penetration have been sprayed via the nozzles 83. Then, later, after the operating pressure has fallen, spread out fog-like liquid has been sprayed.

Figure 10:
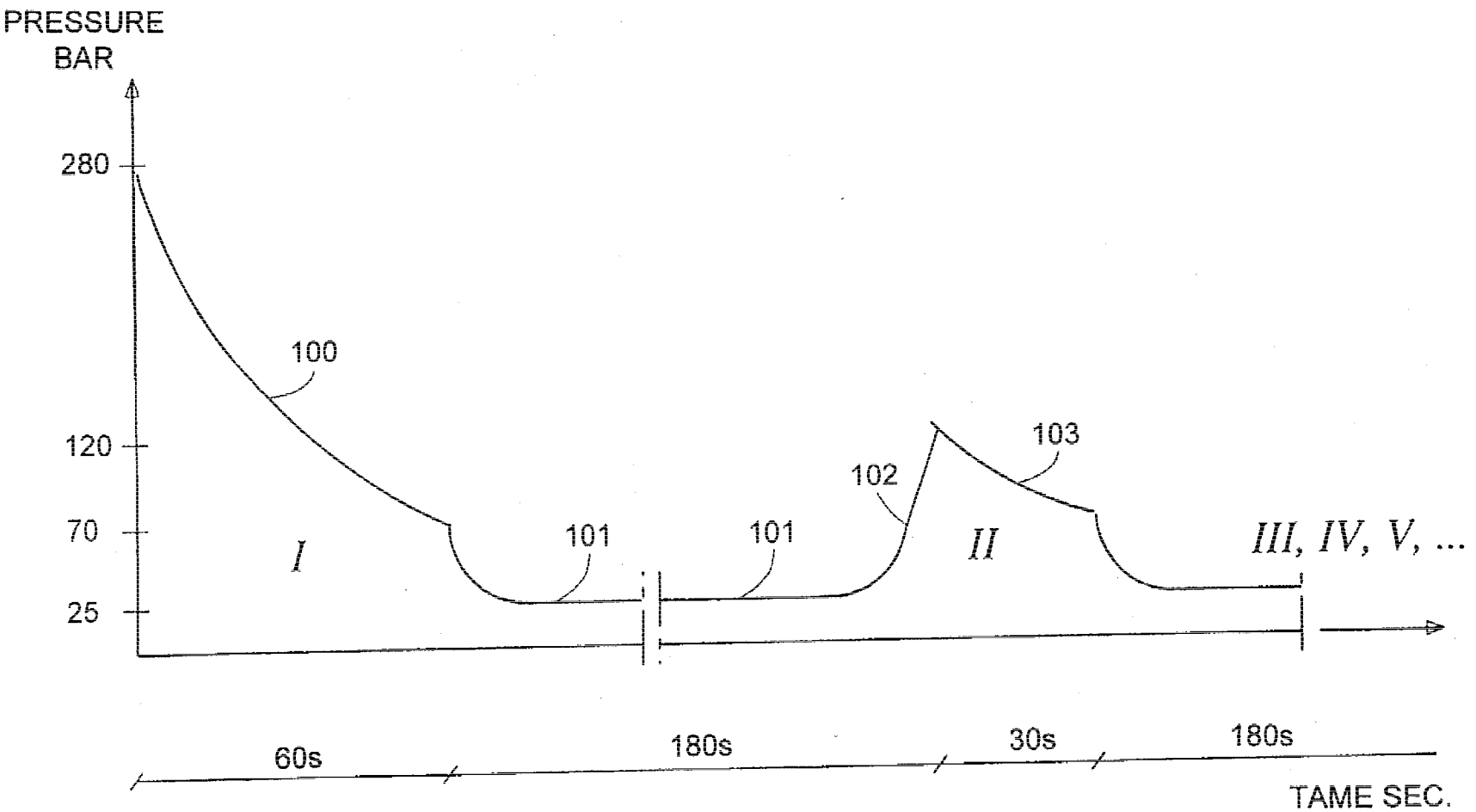
FIGS. 10 and 11 are charts of the extinguishing procedure of the embodiment of FIG. 4 as a function of time and pressure.
Figure 11:
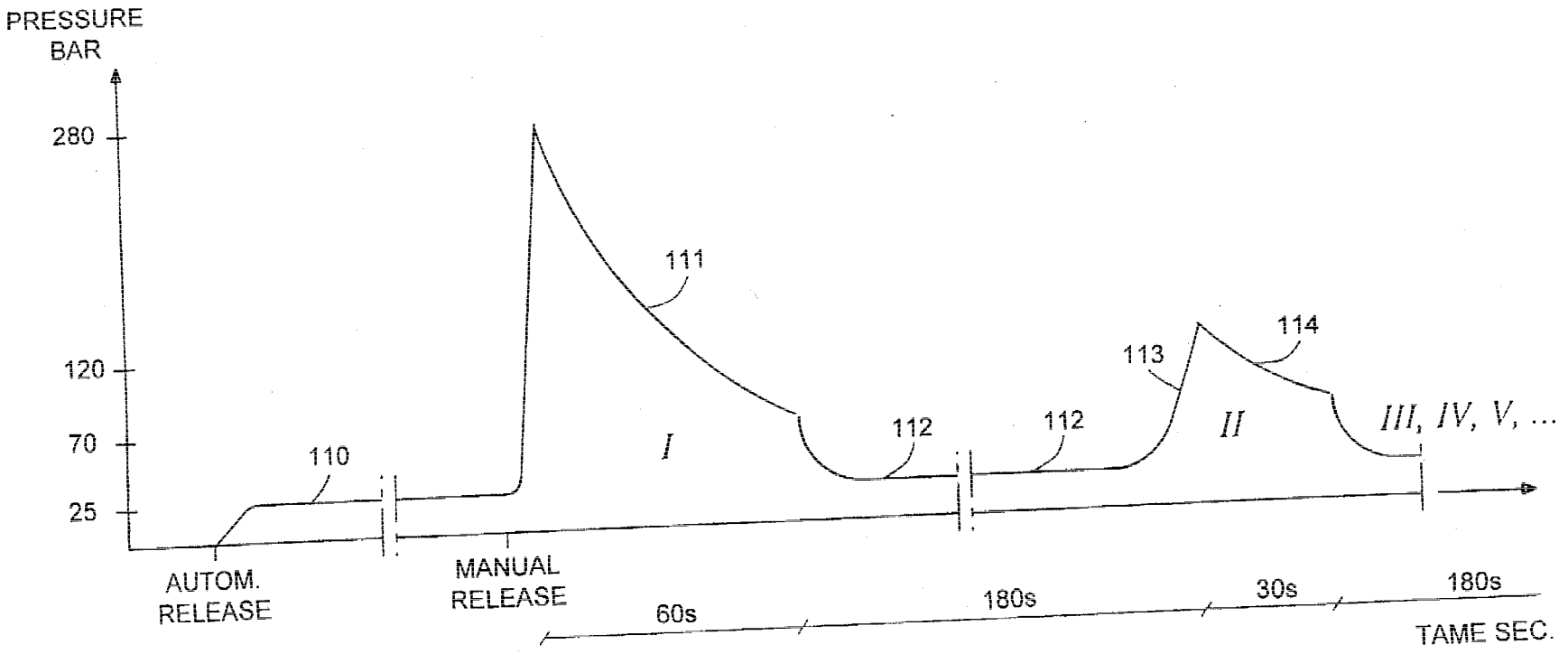

FIGS. 10 and 11 show the extinction procedure of the embodiment according to FIG. 4 as a function of time and pressure. The procedure is similar however, with the other embodiments.

In each of FIGS. 10 and 11, I, II, III, IV, V, . . . indicate the first, second, third, fourth, fifth . . . discharge of one or several of the hydraulic accumulator(s) 41, 41*a*.

A curve section 100 of FIG. 10 includes both spraying of concentrated fog sprays and spread out fog-like sprayings. A curve section 101 refers to spread out fog-like spraying only with liquid supply directly from the pump 50 at a pressure of about 20 to 25 bar. A curve section 102 refers to a partial charging of at least the hydraulic accumulator 41*a*. A section 103 refers to a repeated spread out fog-like spraying, etc.

In FIG. 11, the curve section 110 refers to general spread out fog-like spraying by means of the pump 50 until the fire seat has been located more precisely. A section 111 corresponds to the section 100 in FIG. 10, a section 112 corresponds to the section 101, a section 113 corresponds to the section 102 and a section 114 corresponds to the section 103. The recharging sections 102 and 113 can, naturally, be varied according to need.

I claim:

1. In an installation for fighting fire comprising high pressure hydraulic accumulator means for supplying at least one spray head means with extinguishing liquid for release, the improvements wherein:

the hydraulic accumulator means supplies the extinguishing liquid at pressures gradually decreasing from higher pressures to lower pressures upon the release of the extinguishing liquid from the spray head means; and the spray head means has means for providing a concentrated fog pattern at the higher pressures and providing a fog-like liquid spray that is wider than the concentrated fog pattern at the lower pressures.

2. Installation according to claim 1, wherein the hydraulic accumulator means has a valve for supplying the extinguishing liquid at a first, lowermost pressure at rest when the spray head means is not releasing the extinguishing liquid.

3. Installation according to claim 2, wherein the first pressure at rest is about 5 to 20 bar and the higher pressures are about 100 to 300 bar.

4. Installation according to claim 1, wherein the hydraulic accumulator means comprises several high pressure hydraulic accumulators connected in parallel.

5. Installation according to claim 1, wherein the hydraulic accumulator means comprises a first group of accumulators for delivering the extinguishing liquid and a second group of accumulators for delivering a foam mixture, whereby to prevent reignition of the fire.

6. Installation according to claim 5, and further comprising a pump for delivering low pressure liquid to the spray heads.

7. Installation according to claim 5, wherein the spray head means comprises a plurality of spray heads and the hydraulic accumulator means comprises nonreturn valves for assuring that a pipe system for the supplying of the extinguishing liquid is not emptied of the extinguishing liquid.

8. Installation according to claim 5, wherein the spray head means comprises a plurality of spray heads, the spray heads being positioned above, on the side of and below an object liable to catch fire.

9. Installation according to claim 8, wherein the spray heads positioned on the side and below the object liable to catch fire are nozzles to spray both upwards and downwards.

10. Installation according to claim 5, and further comprising pneumatically driven pumps for charging the accumulators with pressure energy.

11. Installation according to claim 10, wherein at least one of the pumps is a twin pump connected to a foam tank and to a water source.

12. Installation according to claim 11, and further comprising a bypass flow valve in combination with a nonreturn valve for keeping an amount of the foam mixture pumped to each accumulator of the second group of accumulators at a predetermined portion.

13. Installation according to claim 10, further comprising a pneumatically operated activating valve (37) coupled between the accumulators (26, 27) and the spray head means (21–23) and coupled to a pneumatic system which is used for the operation of the pneumatically driven pumps (28, 29, 30), for alternatively opening the connection between the accumulators (26, 27) and the spray head means (21–23) through said outlet line (25), thus activating the discharge for extinction, or closing the connection between the accumulators (26, 27) and the spray head means (21–23) thus preventing charged energy to pass wastedly to said outlet line (25) and the spray head means (21–23).

14. Installation according to claim 13, wherein means are provided for closing said activating valve (37) after the pressure of the accumulators (26, 27) has fallen to a predetermined value, and starting operation of the pumps (28, 29, 30) for recharging the accumulators.

15. Installation according to claim 1, and further comprising a charging pump for charging the hydraulic accumulator means with the pressures, the charging pump being driven by pressure gas.

16. Installation according to claim 15, and further comprising a pump for delivering low pressure liquid to the spray head means.

17. Installation according to claim 15, and further comprising a separately connectable pressure gas holder for charging the hydraulic accumulator means with the pressures in emergency operation.

18. Installation according to claim 15, and further comprising a pressure reducing valve for connecting a gas space of the hydraulic accumulator means to a pressure gas drive unit in emergency operation.

19. Installation according to claim 4, and further comprising throttling means for separating at least one of the hydraulic accumulators from at least one other of the hydraulic accumulators in quick charging of the at least one hydraulic accumulator.

20. Installation according to claim 1, wherein the spray head means comprises a spray head having a housing with a liquid inlet, a central channel continuing in a housing from the inlet, the channel leading to a central-positioned nozzle on the housing for liquid outlet from the housing, channel branchings extending from the central channel, the channel branchings respectively leading to fog-spraying nozzles operable under the higher pressures and being directed from sides of the housing relative to the central-positioned nozzle, a spring loaded valve body movable in the central channel between a first position in which the valve body closes connection between the liquid inlet and the central channel and a second position in which the valve body closes connection from the central channel to the central-positioned nozzle for a flow split between the nozzles when the valve body is in an intermediate position between the first and second positions, the first position corresponding to a first, lowermost liquid pressure at the liquid inlet and the second position corresponding to the higher pressures.

21. Installation according to claim 20, wherein the central-positioned nozzle has a lesser flow resistance than the fog-spraying nozzles.

22. Installation according to claim 20, wherein the valve body comprises a cone facing the liquid inlet for cooperation with a corresponding conical sealing surface in the liquid inlet.

23. Installation according to claim 20, wherein the valve body is arranged to be in said second position thus having the connection between the liquid inlet (85) and the central channel (86) closed at pressures somewhat higher than regular water pipe pressure, such as about 7 bar, the connection between the central channel (86) and the central nozzle (84) being arranged to be operated at pressure lower than said somewhat higher pressure.

24. Installation according to claim 23, wherein the valve body (88) is arranged to have the connection between the liquid inlet (85) and the central channel (86) open at regular water pipe pressure, such as about 7 bar.

* * * * *